United States Patent [19]

Peterson

[11] 4,115,894

[45] Sep. 26, 1978

[54] TOOTHBRUSH FOR SIMULTANEOUS-SURFACE AND SULCUS CLEANING

[76] Inventor: Vacharee S. Peterson, 1618 Eustis, Apt. 7, St. Paul, Minn. 55108

[21] Appl. No.: 788,128

[22] Filed: Apr. 18, 1977

[51] Int. Cl.[2] ..... A46B 9/04

[52] U.S. Cl. ..... 15/167 R

[58] Field of Search ..... 15/167 R, 167 A, 171, 15/182, 186, 187, 188, 110, 104.94; 132/84 R, 84 A, 84 B

[56] References Cited

U.S. PATENT DOCUMENTS

| | | | |
|---|---|---|---|
| 1,132,326 | 3/1915 | Fouyer | 15/167 R |
| 2,244,615 | 6/1941 | Garcin | 15/167 A |
| 2,807,820 | 10/1957 | Dinhofer | 15/167 R X |

FOREIGN PATENT DOCUMENTS

| | | | |
|---|---|---|---|
| 449,836 | 7/1936 | United Kingdom | 15/167 R |

*Primary Examiner*—Edward J. McCarthy
*Attorney, Agent, or Firm*—Temple Clayton

[57] ABSTRACT

Toothbrushes are provided having bristles oriented for cleaning of surface areas and sulcus interstices and particularly to toothbrushes adapted to cleaning of more than one tooth surface and sulcus simultaneously.

4 Claims, 11 Drawing Figures

TOOTHBRUSH FOR SIMULTANEOUS-SURFACE AND SULCUS CLEANING

Figure 1:
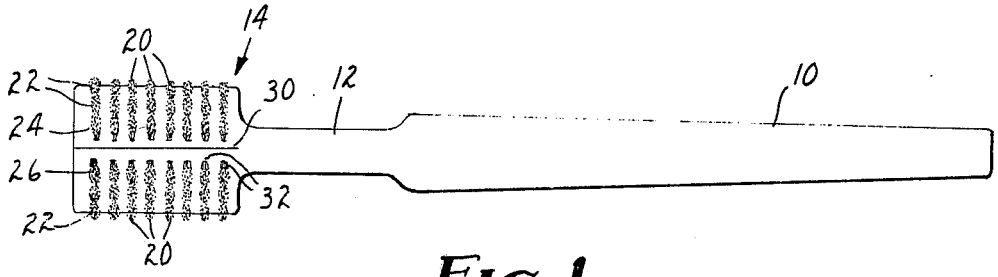

This invention relates to toothbrushes and particularly to toothbrushes having bristles oriented for cleaning of surface areas and sulcus interstices and particularly to toothbrushes adapted to cleaning of more than one tooth surface and sulcus simultaneously.

Because of the general tendency for both adults and juveniles to neglect adequate brushing of teeth particularly coupled with excessive consumption of sugars there is a heavy incidence of gingivitis and periodontal disease. The incidence is very high usually starting with gingivitis and proceeding rapidly to recession of the gingivae and development of plaque and local infection. When the supporting structure of the teeth is destroyed extraction and replacement may, and often is, necessary. This is a problem unaffected by fluoridation procedures. It is generally accepted by the dental profession that the most satisfactory approach is for satisfactory cleaning of teeth and sulcal interstices at frequent intervals, preferably after eating.

The usual procedure in brushing teeth is to hold the brush so that the bristles are more or less normal to the surface and brush either up and down, sidewise or in a circular motion. Because the bristles are essentially normal to the surface very little action is effected on sulcal interstices and removal of bacteria to prevent plaque build-up is not accomplished. Modern dental teaching recommends horizontal movement of the brush with bristles at an angle to the surface of the tooth of about 45° so as to enter into sulcal interstices and effect cleaning. With the usual stiff bristled tooth brushes having the bristles erect and relatively short it is very difficult and sometimes even painful to follow recommended procedures. The usual result is injury to the gingiva and possible further recession thereof.

In U.S. Pat. No. 3,922,020 is described a toothbrush having a combination of erect and angled bristles arising from a stepped head portion in which the angled bristles are inserted in a laterally or centrally raised portion of the head alternating to the head portion. A possible disadvantage of such an arrangement is that pressure to bend the erect bristles may be necessary before the angled bristles can enter the sulcus for cleaning thereof. A further disadvantage may be that repeated repositioning of the brush for operating in upper and lower and inner and outer surfaces may tend to shorten time actually devoted to brushing. Other disadvantages may arise in manufacture which would appear to require complex operations.

It is an object of this invention to provide a toothbrush having improved tooth cleaning ability.

In accordance with aims and objects of the invention it has been found that improved cleaning of teeth is possible using a toothbrush having a broad head comprising at least two head portions on opposite sides of a center line which is continued from the handle preferably with narrowed neck portion below the head portion and with bristles in rows positioned to present bristles simultaneously toward the upper and lower or outer and inner gingivae at an angle of about 30 ° to 60° and preferably about 45°.

In one embodiment of the invention two head portions are rigidly positioned in side to side position on either side of a centerline with their backs in one plane or up to about 40° from one plane and bristles are inserted in the two head portions in rows with the bristles of one head portion at divergent angles from the bristles of the other head portion so that there is substantially no intermingling of bristles on either head portion or between head portions. The bases of innermost rows of bristles may be positioned at greater or less distances from each other than other adjacent rows of bristles. In this embodiment the total width of the head portions is generally slightly less tha their length so that the total head is approximately rectangular although it will be understood that corners are not usually sharply angled and are usually rounded. The overall width between outer rows of bristles of adjacent heads should approximate or slightly exceed the distance between upper and lower gums so that brushes of both juvenile and adult sizes are contemplated. Furthermore in this element the bristles in each head portion diverge from those in the other head portion usually at an angle from about 30 ° to 120° and preferably from about 60° to 120° and more preferably about 90°.

In a second embodiment the head portion is of concave or convex backing with bristles in plurality of rows inserted on either side of a centerline so that there is substantially no intermingling of bristles between the two sides of the centerline and there is an angle of about 30° to 60° between the bristles on the two sides of the centerline. The arrangement of rows of bristles and overall width are substantially in the first embodiment described above.

In yet another, third embodiment of the invention three head portions are rigidly positioned in side by side relation with the bristles of the outer two head portions on their inner faces and converging but not meeting and the bristles of the central head portion are on the reverse outer surface at right angles so that they diverge from the bristles of both outer head portions. The back may be formed of three flat segments at angles of greater than 90° to each other and usually not greater than about 150° or they may be continuously curved generally in the arc of a circle.

It will be recognized that the handle to which the heads are attached in each embodiment can be of a convenient length and advantageously with a constricted or necked portion adjacent the head as this facilitates brushing inner surfaces of the teeth.

As used herein divergent means that outer free ends of bristles are further from each other than the bases of said bristles inserted and secured in one surface of a head portion. Bristles may be of any desired type but are preferably rather soft and preferably are polished nylon.

The invention is now further explained by reference to the drawings herewith which show in diagrammatic fashion various embodiments of the invention with particular reference to the lateral outline of the head portion.

FIG. 1 shows a toothbrush of the invention with handle 10, neck 12, head 14, having bristles 20 in rows 22 with center rows 24 and 26 on either side of centerline 30 and with ends 32 closely inserted.

Figure 2:
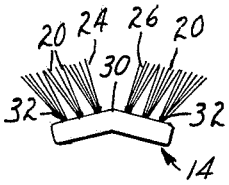

FIG. 2 shows an end view of the head of a toothbrush of the invention with bristles 20 inserted in base with portions at an angle of up to about 40° and relatively wide space between ends 32 of the center two rows 24 and 26 of bristles.

Figure 3:
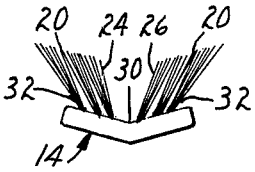
Figure 5:
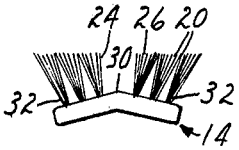
Figure 6:
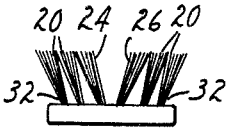

FIGS. 3, 5 and 6 show variations of the head of toothbrushes of the invention varying arrangements of bristles, relative lengths and the head portions from plane (FIG. 6) to angles of about 40° on either side of plane.

These heads are representative of the first above embodiment.

Figure 4:
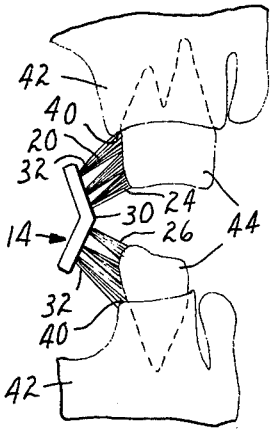

FIG. 4 shows the head of a toothbrush of the invention as applied to teeth showing outer bristles 20 cleaning the sulcal interstices between gums 42 and teeth 44.

Figure 7:
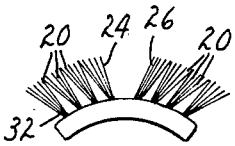

FIG. 7 shows the head of a toothbrush of the invention according to the second above embodiment of the invention.

Figure 8:
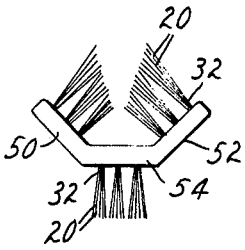
Figure 9:
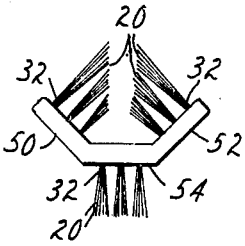
Figure 10:
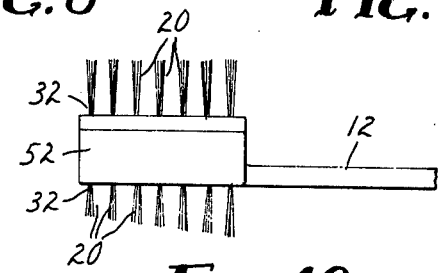

FIGS. 8 and 9 show heads of toothbrushes of the invention according to the third embodiment in which head portions 50, 52 and 54 are set at angles of greater than about 100° and up to about 150° so that bristles 20 of outer head portions converge but of adjacent portions diverge. It is seen that the ends of bristles of outer head portions do not meet but end in planes which may vary from parallel to an angle of about 45°. In the heads of toothbrushes of this embodiment it is preferred that the medium head portion have bristles which increase in length from nearer the handle toward the outer end as shown in FIG. 10.

Figure 11:
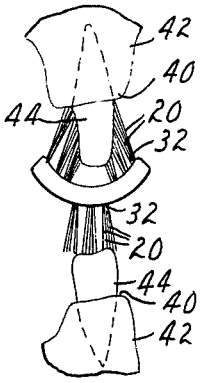

FIG. 11 shows the use of a toothbrush of the invention of the third embodiment having an arcuate back of all three head portions and with outer portions brushing outer surfaces and inner surfaces of upper teeth while the medium head portion brushes occlusal surface of lower teeth. It will be seen that outer rows of bristles of the outer head portions penetrate and clean sulcal interstices.

What is claimed is:

1. A toothbrush consisting essentially of a handle having a necked portion and a head attached to said handle at said necked portion, said head comprising two elongated head portions each having two sides, two ends and two surfaces, one of said two surfaces being a bristle-bearing surface, said head portions being joined in side to side relationship so that said bristle-bearing surfaces together form a face varying from concave to convex and each said head portion having a plurality of bristles of substantially equal length on said bristle-bearing surface disposed in at least two rows extending lengthwise of said head portion and inserted in and secured to said bristle-bearing surface at an angle of less than 90°, and each bristle extending from said head portion to a free end and all the bristles in each said head portion being so inserted in the bristle-bearing surface thereof as to diverge from all the bristles in the adjacent head portion.

2. A toothbrush according to claim 1 wherein there are two head portions at an angle from 0° up to about 40° from a plane and bristles of the one head portion diverge from those of the other portion at angles of from 30° to 120°.

3. A toothbrush according to claim 1 wherein the head portions are joined in side to side relationship in an arc of a circle and the bristles are inserted in rows on either side of the centerline of said arc diverging at an angle of about 30° to 120°.

4. A toothbrush according to claim 2 wherein the surfaces of the head portions in which the bristles are inserted form an angle of about 140°.

* * * * *